US006367761B1

(12) United States Patent
Suzuki

(10) Patent No.: US 6,367,761 B1
(45) Date of Patent: Apr. 9, 2002

(54) PAPER HOLDER

(75) Inventor: Hitoshi Suzuki, Tokyo (JP)

(73) Assignee: Hiromori Inc., Tokyo (JP)

( * ) Notice: Subject to any disclaimer, the term of this patent is extended or adjusted under 35 U.S.C. 154(b) by 0 days.

(21) Appl. No.: 09/566,744

(22) Filed: May 9, 2000

(51) Int. Cl.[7] ..... A47B 97/04

(52) U.S. Cl. ..... 248/451; 40/652; 24/67.11

(58) Field of Search ..... 248/292.13, 316.5, 248/316.7, 442.2, 451, 453; 40/647, 650, 652, 658; 24/67 R, 67.3, 67.5, 67.7, 67.9, 67.11, 531; D8/395; D19/86

(56) References Cited

U.S. PATENT DOCUMENTS

| | | | | | |
|---|---|---|---|---|---|
| 511,366 | A | * | 12/1893 | Sinz | 24/67.7 |
| 2,006,887 | A | | 7/1935 | Doherty | |
| 2,540,546 | A | * | 2/1951 | Putz | 248/316.4 |
| 3,398,475 | A | | 8/1968 | Palmer | |
| 4,097,971 | A | | 7/1978 | Morris | |
| 4,261,121 | A | | 4/1981 | Coon | |
| 4,525,899 | A | | 7/1985 | Carroll | |
| D333,154 | S | * | 2/1993 | Hiromori | D19/65 |
| 5,335,399 | A | | 8/1994 | Chou | |
| 5,479,682 | A | | 1/1996 | Hendrikx et al. | |
| 5,621,950 | A | | 4/1997 | White | |
| 5,667,183 | A | | 9/1997 | Hiromori | |
| 5,697,594 | A | | 12/1997 | Adams et al. | |
| 5,845,889 | A | | 12/1998 | Suzuki | |
| D419,602 | S | * | 1/2000 | Mori | D19/91 |

FOREIGN PATENT DOCUMENTS

| | | |
|---|---|---|
| JP | 63/23169 | 6/1988 |

* cited by examiner

*Primary Examiner*—Anita King
*Assistant Examiner*—Jon Szumny
(74) *Attorney, Agent, or Firm*—Dilworth & Barrese, LLP

(57) ABSTRACT

A paper holder is provided in which the moving parts are shielded as much as possible to avoid injuring an individual using the same. An elastic biasing member for biasing a moving holding member towards a fixed holding member and thereby securing paper is entirely shielded from contact with an individual and is disposed to extend in a direction towards the fixed holding member.

14 Claims, 5 Drawing Sheets

PAPER HOLDER

BACKGROUND OF THE INVENTION

The present invention relates to a paper holder for holding paper or the like and in which an individual's fingers are protected from being caught in moving components during use.

A variety of paper holders have been developed for retaining sheets of paper that can be easily seen while operating, e.g., a word processor, typewriter, personal computer, etc. For example, U.S. Pat. No. 5,667,183 to Hiromori discloses a paper holder having complementary convex and concave surfaces to retain paper in an upright and somewhat curved state. U.S. Pat. No. 5,845,889 to Suzuki discloses a paper clip in which two clamping members are pivotally coupled together and biased into abutment by a spring, with one of the clamping members being additionally pivotally mounted upon a fixed base plate.

Paper holders generally have a large number of exposed moving parts, resulting in the danger of unavoidably catching one's fingers during use. Accordingly, it is an object of the present invention to eliminate the disadvantages and dangers encountered with prior art paper holders.

More particularly, it is an object of the present invention to provide a paper holder which minimizes or eliminates danger of catching one's fingers in moving components thereof.

It is also an object of the present invention to improve retention and clamping of paper in an upright position to be viewed, e.g., adjacent a computer, word processor, etc.

It is further object of the present inventor to provide a paper holder which is adapted for different tasks such as brushing away dust particles.

SUMMARY OF THE INVENTION

These and other objects are attained by the present invention which is directed to a paper holder comprising two holding members, a first holding member provided with a convex holding surface and a second holding member provided with a substantially complementary concave holding surface, plus a base portion extending from a lower end of one of the first and second holding members. At least one spindle is provided on either the base portion or a wall portion of the holding member mounted thereon and upon which the other holding member is pivotally mounted, such that the pivotal holding member can be pivoted away from the complementary holding member by pushing a portion, e.g., a top portion, of the pivotal holding member. An elastic or resilient member is also arranged to bias the holding surfaces of the first and second holding members together under pressure, the elastic member being structured and arranged to extend in a direction toward the non-pivotal, i.e. fixed, holding member whereby paper situated between the holding surfaces is retained in an erect and somewhat curved state.

The elastic or resilient member is structured and arranged to extend in a direction substantially parallel to a bottom surface of the base portion and/or in a substantially horizontal direction (i.e., when the paper holder is placed upon a horizontal flat surface). Furthermore, the elastic member is arranged to move by rotating the pivotal holding member such that when the pivotal hold member is pivoted by a finger and then released, both the elastic member and pivotal holding member move in a substantially circular arc. The pivotal holding member is also mounted upon the base or fixed holding member to completely encompass the elastic member and thus shield the elastic member from contacting an individual's fingers.

The various components constituting the paper holder are compactly arranged and, in a preferred embodiment, can accommodate a brush which can be extended to brush away dust particles, e.g., static particles.

Thus, a compact paper holder is provided with a minimal number of exposed, protruding, moving compacts. Therefore, the danger of accidently catching one's fingers in moving parts of the paper holder during use is greatly minimized if not totally eliminated. Furthermore, reliability and ease in clamping and retention of paper in an upright, easily-viewed position is improved with the inventive paper holder.

BRIEF DESCRIPTION OF THE DRAWINGS

The present invention will be explained in greater detail by way of the accompanying drawings, in which.

DESCRIPTION OF THE PREFERRED EMBODIMENTS

Figure 1:
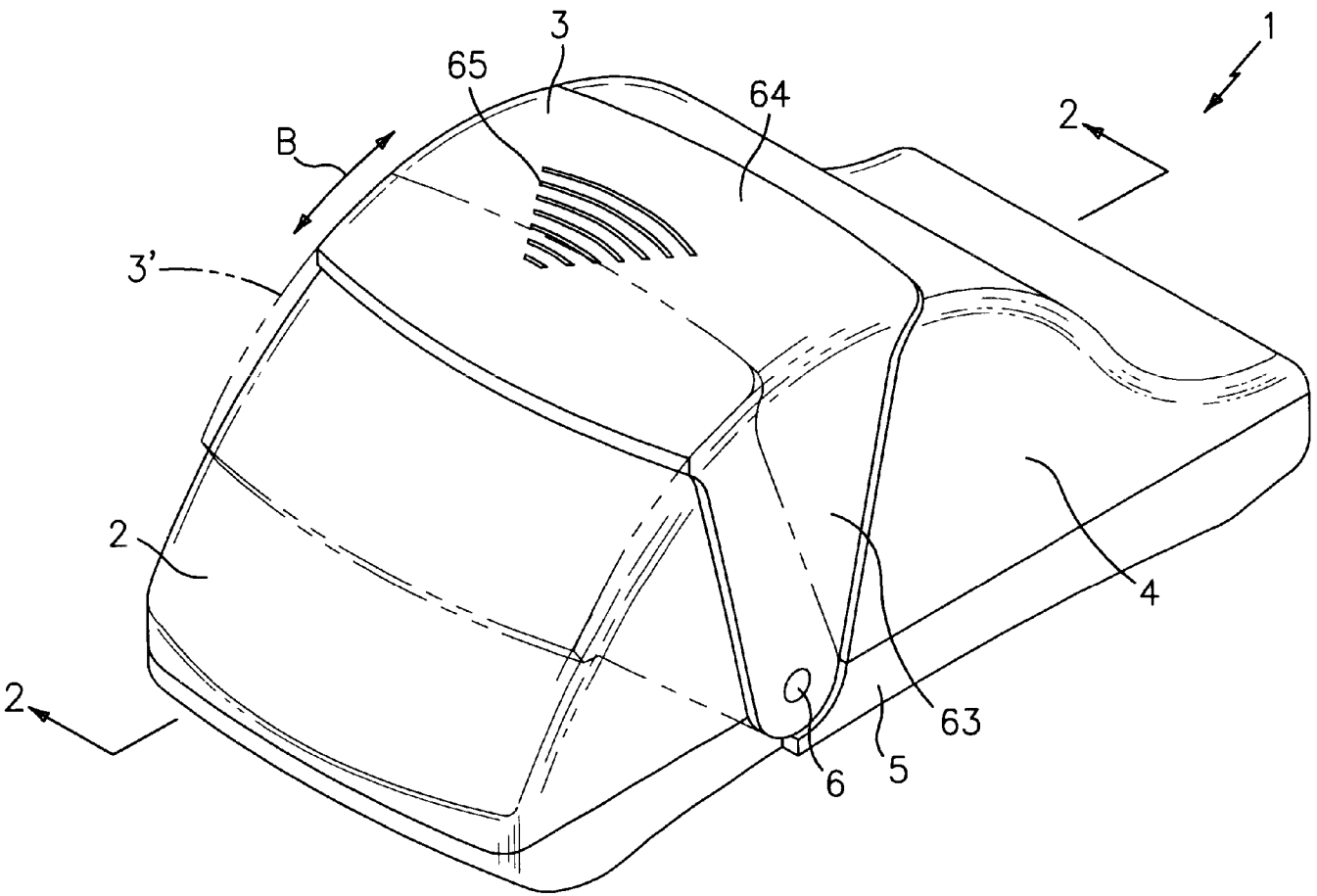
FIG. 1 is a perspective view of the paper holder in accordance with the present invention.

Referring to the drawings, in which the same or similar elements are denoted by the same reference numerals or reference numerals with prime (') superscripts, the paper holder 1 of the present invention comprises a base 5, a fixed holding member 4 positioned on the base 5 to extend upwardly therefrom and a movable holding member 3 pivotally mounted with respect to the fixed holding member 4 and base 5. The movable 3 and fixed 4 holding members respectively have convex 8 and concave 7 surfaces which are substantially complementary to one another. Alternatively, the concave surface can be provided on the movable holding member 3 and the convex holding surface on the fixed holding member within the context of the present invention.

Figure 2:
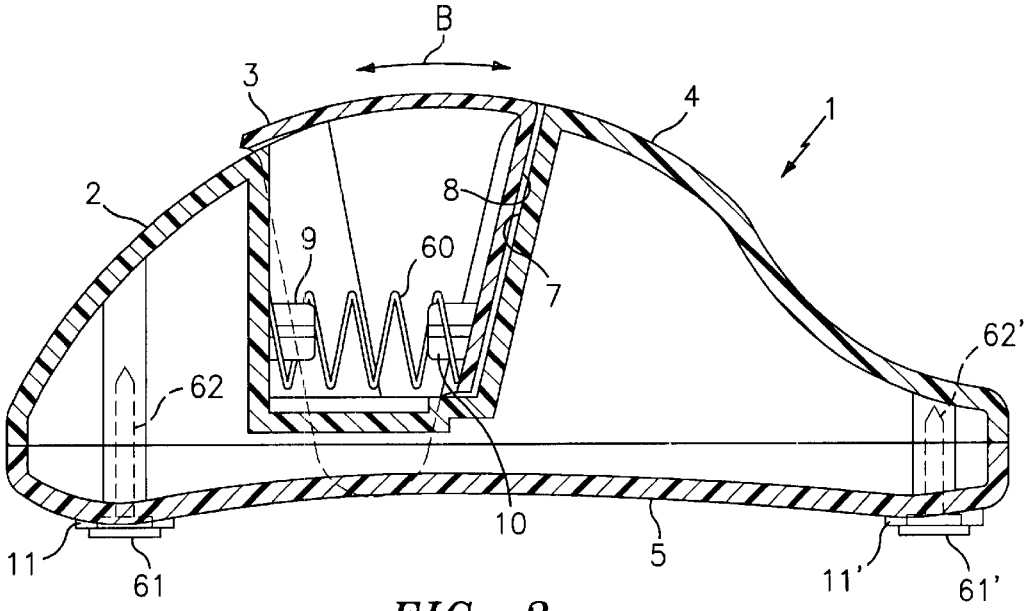
FIG. 2 is a sectional view in the along line 2—2 in FIG. 1.
Figure 3:
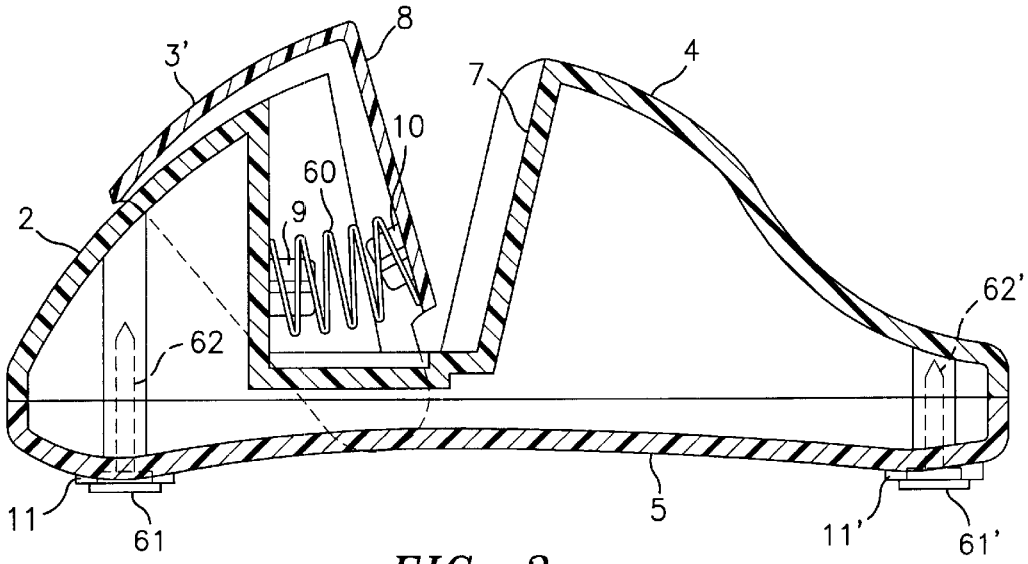
FIG. 3 is a sectional view similar to FIG. 2 and illustrating the paper holder in retracted (open) position.
Figure 4:
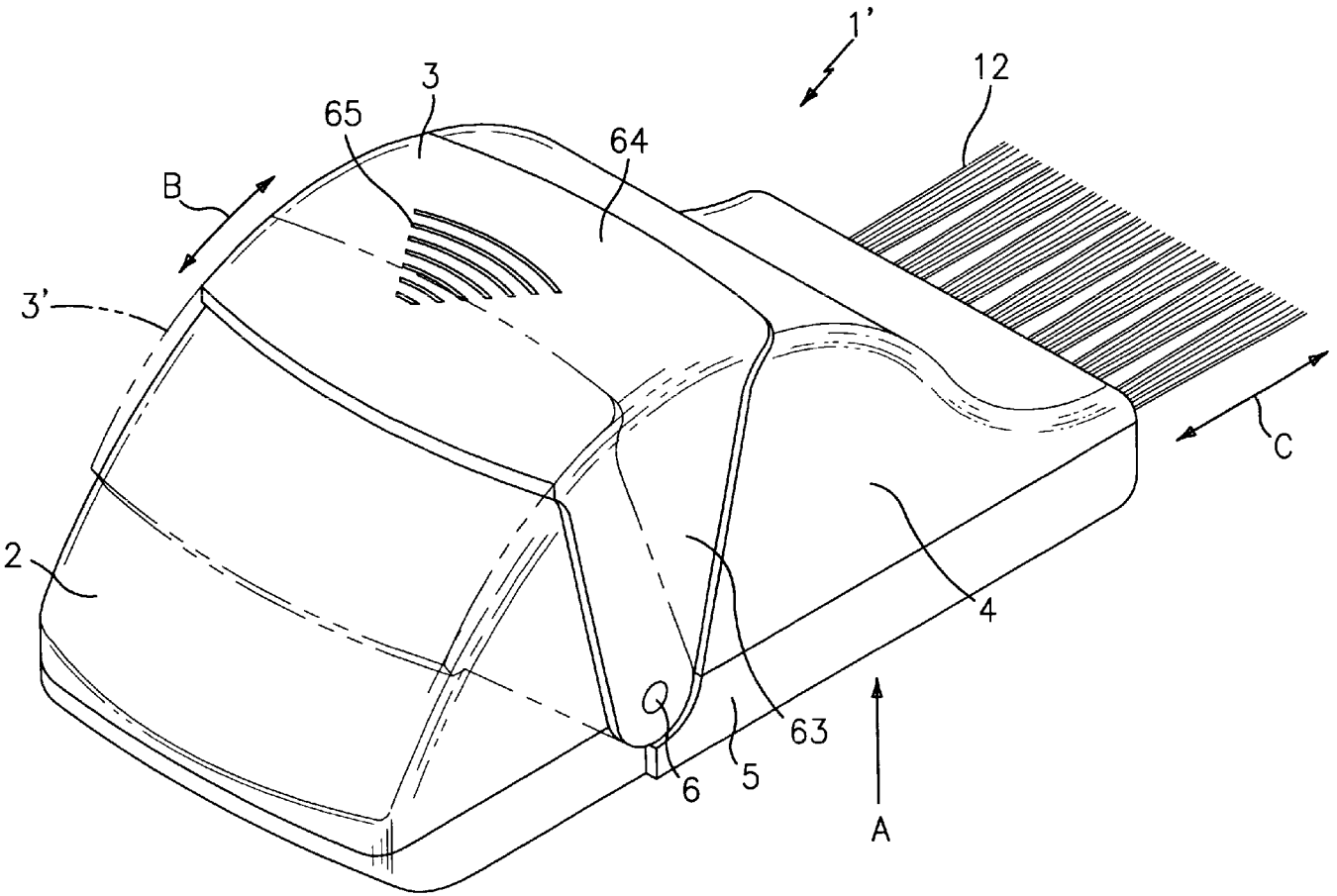
FIG. 4 is a perspective view of an alternative embodiment of the paper holder.
Figure 5:
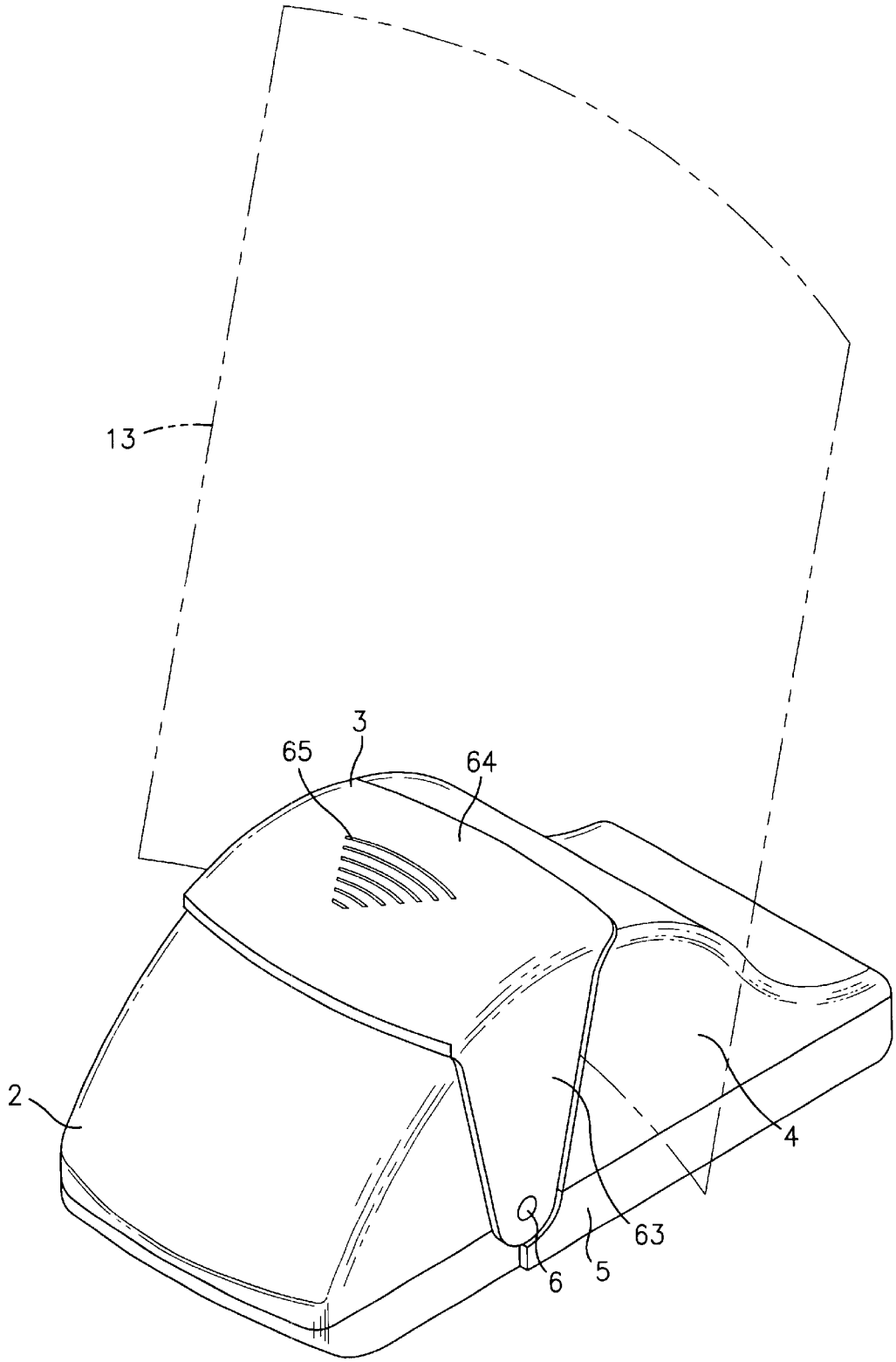
FIG. 5 is a perspective view similar to FIGS. 1 and 5 and illustrating retention of a sheet of paper by the paper holder.

The movable holding member 3 is pivotally mounted upon the base through two spindles, only one spindle 6 being illustrated in the perspective views of FIGS. 1, 4 and 5 (the other spindle is positioned on the exact opposite side of the paper holder 1 in a symmetrical manner). Furthermore, the movable holding member 3 is biased into a closed position, i.e., the position where surfaces 8 and 7 are in contact by a resilient or elastic member 60 which can be, e.g., a coil spring. Alternatively, other resilient biasing means, e.g., a leaf spring or slender spring in the shape of a U, can be utilized within the purview of the present invention. As shown in the sectional views of FIGS. 2 and 3, the coil spring 60 is secured at one end about a t-shaped peg 9 mounted upon a rear section 2 of the base 5 and at an opposite end about a t-shaped peg 10 secured to an interior surface of the movable member 3 on an opposite side from the convex surface 8.

As shown in FIG. 3, the movable member 3 can be rotated, e.g., with a finger, against the biasing force of coil spring 60 and in a direction away from the fixed holding member 4 to a position denoted by reference numeral 3' in FIGS. 1 and 3 and illustrated in phantom in FIG. 1. A paper 13 can be inserted between surfaces 7 and 8 in the retracted position shown in FIG. 3. Then, the movable member 3 is slowly released so that it returns to the initial position shown in FIGS. 1 and 2 and paper 13 is retained between the holding member as shown in FIG. 5 (please see double headed arrow B in FIGS. 1 and 2 which denotes pivoting directions of movable member 3).

The components forming the base 5, fixed holding member 4 and movable holding member 3 can be molded from hard plastic or similar synthetic resin and with each component, e.g., the movable member 3, optionally molded from clear or transparent plastic. In the illustrated embodiment, the base 5 and rear section 2/holding member 4 are separately molded as two sections and then joined together by placement of fixing bolts 62, 62', etc. screwed into openings through respective legs 11, 11', 11", 11'" in base 5 (the screw bolts 62 and 62' are illustrated in FIGS. 2 and 3). Additionally, rubber discs 61, 61', 61", 61'" are inserted to seal the openings in legs 11, 11', 11", 11'" as illustrated.

Figure 6:
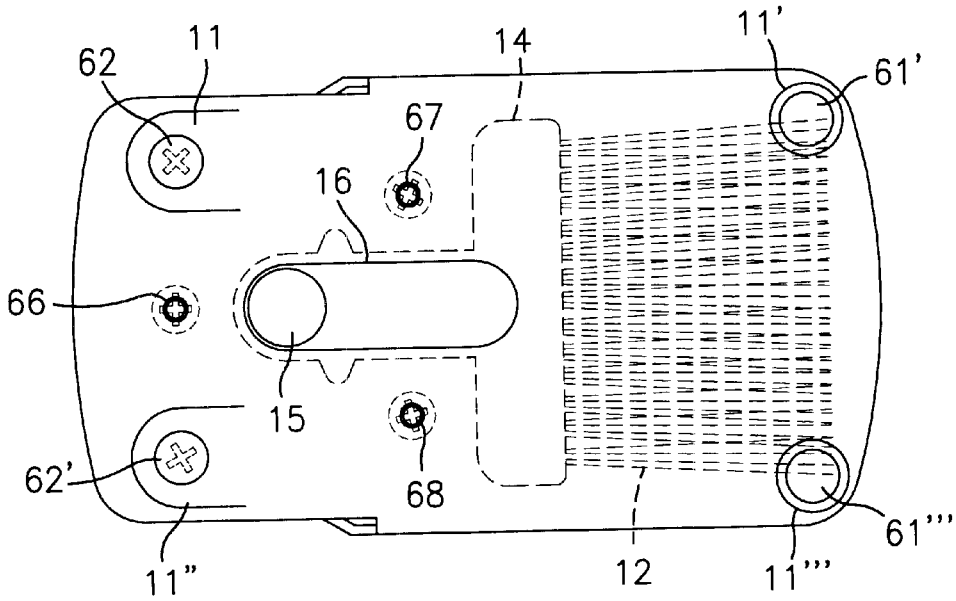
FIG. 6 is a bottom plan view of the alternative embodiment of FIG. 4 and illustrating retraction of an anti-static brush there into.
Figure 7:
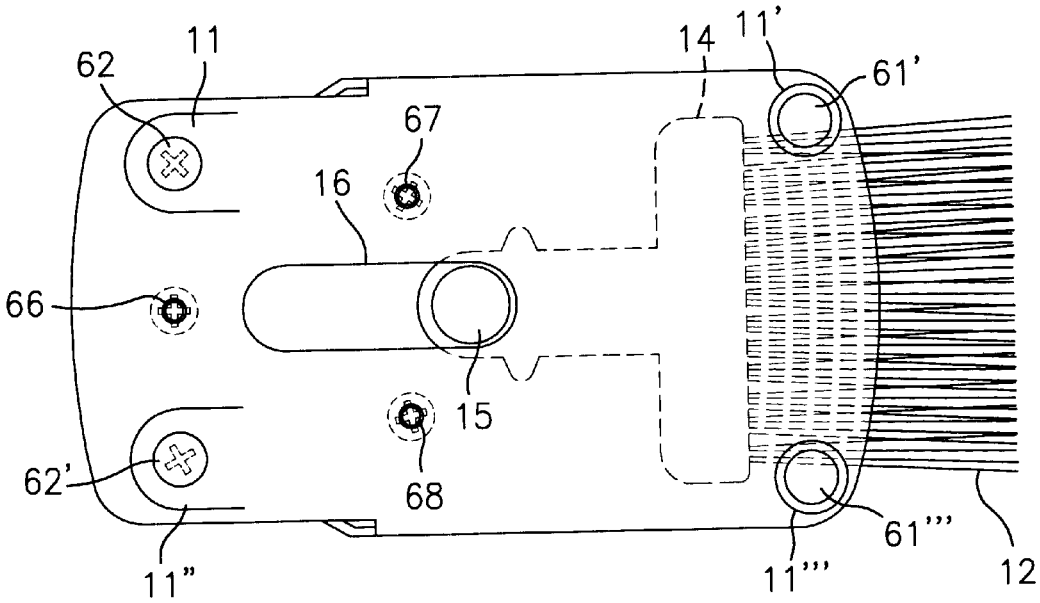
FIG. 7 is a bottom plan view in the direction of arrow A in FIG. 4.

The embodiment of the paper holder 1' illustrated in FIGS. 4, 6 and 7 is identical to the first embodiment supra in all respects, and is additionally provided with an anti-static brush 12 that can be extended and retracted in the directions of the double-headed arrow C in FIG. 4 as shown in the bottom views of the FIGS. 6 and 7 (the bottom molded section of base 5 can be molded from clear, transparent plastic). The brush 12 sits, in retracted position, entirely within an interior compartment defined with the base 5. A peg 15 affixed to handle portion 14 of the brush 12 protrudes below the base 5 through an oblong-shaped slot 16 therethrough. By simply pushing the peg 15 forward to the right in FIG. 6, the brush 12 can be extended as shown in FIGS. 4 and 7; the brush 12 is simply retracted by moving the peg 15 in an opposite direction. The anti-static nature of the brush 12 helps remove dust off e.g., a computer monitor, keyboards, etc. The screw bolts provided in the first embodiment shown in FIGS. 1–3 and 5 are realigned in the embodiment shown in FIGS. 4, 6 and 7 to allow for accommodating brush 12 within the base 5 of the paper holder 1'. More specifically, screw bolts 61' and 61'" are omitted, with additional screw bolts 66-68 being provided as illustrated.

In the paper holder 1,1' of the present invention, the elastic/resilient member 60 is structured and arranged to extend in a direction toward the fixed holding member 4 to bias the holding surfaces 7 and 8 together. More particularly, the coil spring 60 is arranged to extend in a direction substantially parallel to a bottom surface of the base 5 and/or in a substantially horizontal direction. Thus, when the holding member 3 is retracted to position 3', the coil spring 6 also moves by way of rotation in a substantially circular arc and when holding member 3' is released, both coil spring 60 and holding member 3' move in a substantially circular arc (see arrow B in FIGS. 1 and 2). Furthermore, the paper holder 1,1' is compact with few protruding parts and a generally round, curved appearance. In this regard, the movable, pivotal member 3 is structured and arranged so that the elastic/resilient member 60 remains unexposed at all times.

The only exposed moving surface is the clamping surface 8 for the paper. In particular, two flanges, only one of which 63 is shown in FIGS. 1, 4 and 5, extend downwardly from a cover 64 of the movable member 3 and are mounted upon the respective spindles 6. Thus, the pivotal holding member 3 entirely covers the compartment in which the moving coil spring 60 is positioned. Reference numeral 65 denotes a gripping surface for a finger to rotate the pivotal holding member 3.

The preceding description of the present invention is merely exemplary and is not intended to limit the scope thereof in any way.

What is claimed:

1. A paper holder, comprising two holding members, a first holding member provided with a convex holding surface and a second holding member provided with a substantially complementary concave holding surface, a base portion extending from a lower end of one of said first and second holding members, at least one spindle provided on either said base portion or a wall portion of said one of said holding members and upon which the other of said first and second holding members is pivotally mounted, such that said pivotal holding member can be separated from said one holding member by pushing said pivotal holding member, and an elastic member arranged to bias said holding surfaces of said first and second holding members together under pressure, said elastic member structured and arranged to extend in a direction toward said one holding member such that paper situated between said two holding surfaces is retained in an erect and somewhat curved state, wherein said pivotal holding member substantially encloses said elastic member to prevent contact between an individual operating said paper holder and said elastic member.

2. The paper holder of claim 1, wherein said elastic member is structured and arranged to extend in a direction substantially parallel to a bottom surface of said base portion.

3. The paper holder of claim 1, wherein said elastic member is structured and arranged to extend and bias in a substantially horizontal direction.

4. The paper holder of claim 1, wherein said elastic member is mounted upon a wall portion extending upwardly from said base portion and positioned opposite the holding surface of said one holding member and, at an opposite end thereof, upon an inner surface of said pivotal holding member on a side thereof opposite the holding surface thereof.

5. The paper holder of claim 1 comprising two spindles provided on said base portion or wall portion of said one holding member.

6. The paper holder of claim 1, wherein said first holding member provided with said convex holding surface comprises said base portion and said)second holding member provided with said substantially complementary concave holding surface is pivotally mounted thereon.

7. The paper holder of claim 1, wherein said base portion extends in a direction at a substantially right angle to said lower end of said one holding member, forming a leg portion to maintain said holder in upright position.

8. The paper holder of claim 1, wherein said elastic member is a coil spring.

9. The paper holder of claim 1, additionally comprising a recessed compartment in said base portion arranged to receive an anti-static brush.

10. The combination of a paper holder and anti-static brush, comprising two holding members, a first holding member provided with a convex holding surface and a second holding member provided with a substantially complementary concave holding surface, a base portion extending from a lower end of one of said first and second holding members, at least one spindle provided on either said base portion or a wall portion of said one of said holding members and upon which the other of said first and second holding members is pivotally mounted, such that said pivotal holding member can be separated from said one holding member by pushing said pivotal holding member, and an elastic member arranged to bias said holding surfaces of said first and second holding members together under pressure, sais elastic member structured and arranged to extend in a direction toward said one holding member, whereby paper situated between said two holding surfaces is retained in an erect and somewhat curved state, additionally comprising a recessed. compartment in said base portion arranged to receive said anti-static brush, and said anti-static brush mounted to extend from and retract into said compartment in a direction substantially parallel to the direction said elastic member extends.

11. The paper holder of claim 10, wherein said anti-static brush additionally extends and retracts in a direction substantially parallel to a bottom surface of said base portion.

12. The paper holder of claim 1, wherein said elastic member is structured and arranged to move and be moved by way of rotation such that said elastic member and pivotal holding member both move in a substantially circular arc.

13. A paper holder comprising two holding members, a first holding member provided with a convex holding surface and a second holding member provided with a substantially complementary concave holding surface, a base portion extending from a lower end of one of said first and second holding members, at least one spindle provided on either said base portion or a wall portion of said one of said holding members and upon which the other of said first and second holding members is pivotally mounted, such that said pivotal holding member can be separated from said one holding member by pushing said pivotal holding member, the holding surface of said pivotal holding member having a front side and an opposite rear side, and an elastic member arranged to bias said holding surfaces of said first and second holding members together under pressure, wherein said elastic member is positioned to engage the rear side of said holding surface of said pivotal holding member to urge the pivotal holding member towards said one of said holding members in a direction substantially parallel to a bottom surface of said base portion, whereby paper situated between said two holding surfaces is retained in an erect and somewhat curved state.

14. The paper holder of claim 13, wherein said pivotal holding member entirely shields said elastic member from contact with an individual operating the paper holder.

* * * * *